US010247383B2

(12) United States Patent
Tessnow et al.

(10) Patent No.: US 10,247,383 B2
(45) Date of Patent: Apr. 2, 2019

(54) VEHICLE LAMP WITH ARTICULATED MULTI-PIECE HEAT SINK

(71) Applicants: Thomas Tessnow, Weare, NH (US); Ronald E. Boyd, Jr., Chichester, NH (US); Lawrence Rice, Hillsboro, NH (US); Michael Tucker, Henniker, NH (US)

(72) Inventors: Thomas Tessnow, Weare, NH (US); Ronald E. Boyd, Jr., Chichester, NH (US); Lawrence Rice, Hillsboro, NH (US); Michael Tucker, Henniker, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/689,972

(22) Filed: Aug. 29, 2017

(65) Prior Publication Data

US 2019/0063718 A1 Feb. 28, 2019

(51) Int. Cl.
*F21S 45/40* (2018.01)
*F21S 41/143* (2018.01)
*F21S 41/657* (2018.01)

(52) U.S. Cl.
CPC ..... *F21S 45/40* (2018.01); *F21S 41/143* (2018.01); *F21S 41/657* (2018.01)

(58) Field of Classification Search
CPC ..... F21S 45/40; F21S 41/143; F21S 41/657
See application file for complete search history.

(56) References Cited

U.S. PATENT DOCUMENTS 7,329,033 B2 2/2008 Glovatsky et al.
9,115,861 B2 8/2015 Sieme
2010/0264821 A1* 10/2010 Lutz ..... F21V 14/02 315/32

* cited by examiner

*Primary Examiner* — Laura Gudorf
(74) *Attorney, Agent, or Firm* — Edward S. Podszus

(57) ABSTRACT

A motor vehicle lamp (100), comprising a lamp housing (110) defining an interior compartment (116) and an exterior region (102); a solid-state light source (120) disposed on a first heat sink (150) in thermal communication therewith, the first heat sink (150) being disposed within the interior compartment (116); a second heat sink (170) having an heat-transferring exterior section (178) disposed in the exterior region (102) of the lamp housing (110) and further having a heat-transferring receiver section (176) disposed at least partially within the interior compartment (116); and the first heat sink (150) being in thermal communication with the second heat sink (170) and coupled in displaceable relationship to the second heat sink (170), whereby a position of said solid-state light source (120) is adjustable relative the lamp housing (110).

15 Claims, 7 Drawing Sheets

VEHICLE LAMP WITH ARTICULATED MULTI-PIECE HEAT SINK

CROSS REFERENCE TO RELATED APPLICATIONS

N/A

TECHNICAL FIELD

The present disclosure relates to a vehicle lamp with an articulable multi-piece heat sink, which may particularly be a headlamp.

BACKGROUND AND ACKNOWLEDGED PRIOR ART

Light-emitting diodes (LEDs) are used as the light source for certain motor vehicle headlamps. In certain applications, an LED is affixed to a heat sink, both of which are wholly contained within the confines of the headlamp. In such instance, heat from the LED is transferred to the heat sink, which heats the volume of air within the headlamp. The heat may then be transferred through the lamp housing to an environment outside the housing. However, such heat transfer may not be very efficient, and thus require the use of a relatively large heat sink, which adds weight to the vehicle and increases packaging size. For example, a passive heat sink made of aluminum to transfer heat from a 20 watt LED may weigh up to one pound (453.6 grams), with dimensions of approximately 100 mm×100 mm×80 mm. In addition, the lamp housing must be large enough to allow for air to circulate through the heat sink and to dissipate heat through the housing wall. An example of such a headlamp is the current Ford F-150 headlamp or the Ford Explorer headlamp.

However, while such cooling is sufficient for larger headlamps, which offer a suitable internal air volume and/or housing size for thermal dissipation, such a structure and method for thermal dissipation may be inadequate for smaller headlamps, which may be required to operate at the same power levels as the larger headlamps.

A heat sink may be able to provide more efficient cooling if it extended outside the headlamp housing. However, motor vehicle headlamps, particularly the low and high beam LED modules, generally must be movable (e.g. to tilt/pivot up or down) by a few degrees to allow for adjusting vertical aim. Given the LED module is affixed to the heat sink, the heat sink must also be movable, e.g. to tilt/pivot up or down, to correspondingly move the LED module. However, it has not been possible to tilt/pivot the heat sink, while at the same time extending the heat sink outside the lamp housing to provide more efficient cooling, and sealing the heat sink relative to the lamp housing to inhibit contaminates from entering the lamp housing,

SUMMARY

The present disclosure provides a motor vehicle lamp with a solid-state light source operable with a (passive) multi-piece heat sink. The multi-piece heat sink (1) permits the a solid-state light source to be adjusted for vertical aim, (2) extends outside the lamp housing to provide more efficient cooling, and (3) seals with the lamp housing to inhibit contaminates from entering the lamp housing.

The multi-piece heat sink comprises a first heat sink which supports the solid-state light source, and is adjustable (tiltable/pivotable) to adjust the vertical aim of the solid-state light source. A second heat sink extends outside the lamp housing, seals with the lamp housing, and is arranged to transfer heat away from the first heat sink.

In an embodiment, the present disclosure provides a motor vehicle lamp, comprising a lamp housing defining an interior compartment and an exterior region; a solid-state light source disposed on a first heat sink in thermal communication therewith, the first heat sink being disposed within the interior compartment; a second heat sink having a heat-transferring exterior section disposed in the exterior region of the lamp housing and further having a heat-transferring receiver section disposed at least partially within the interior compartment; and the first heat sink being in thermal communication with the second heat sink and coupled in displaceable relationship to the second heat sink, whereby a position of said solid-state light source is adjustable relative the lamp housing.

In an embodiment of the lamp, at least one of the first heat sink and the receiver section of the second heat sink has at least one heat transfer protrusion; at least one of the first heat sink and the receiver section of the second heat sink has at least one recess; and at least one of the at least one heat transfer protrusion and the at least one recess is displaceable relative to one another when the first heat sink and the second heat sink are coupled in displaceable relationship.

In an embodiment of the lamp, the at least one heat transfer protrusion is disposed within the at least one recess.

In an embodiment of the lamp, at least one of the first heat sink and the receiver section of the second heat sink has a plurality of heat transfer protrusions; at least one of the first heat sink and the receiver section of the second heat sink has a plurality of recesses; and at least one of the plurality of heat transfer protrusions and the plurality of recesses is displaceable relative to one another when the first heat sink and the second heat sink are coupled in displaceable relationship.

In an embodiment of the lamp, each heat transfer protrusion of the plurality of heat transfer protrusions is disposed within a recess of the plurality of recesses.

In an embodiment of the lamp, at least one of the first heat sink and the receiver section of the second heat sink has a plurality of heat transfer protrusions and at least one recess; and the at least one recess is disposed between adjacent heat transfer protrusions of the plurality of heat transfer protrusions.

In an embodiment of the lamp, at least one of the first heat sink and the receiver section of the second heat sink has a plurality of recesses; and each recess of the plurality of recesses is disposed between adjacent heat transfer protrusions of the plurality of heat transfer protrusions.

In an embodiment of the lamp, the first heat sink has a plurality of heat transfer first protrusions and a plurality of first recesses; the receiver section of the second heat sink has a plurality of heat transfer receiver section protrusions and a plurality of receiver section recesses; each first protrusion of the plurality of first protrusions is disposed within a receiver section recess of the plurality of receiver section recesses, respectively; and each receiver section protrusion of the plurality of receiver section protrusions is disposed within a first recess of the plurality of first recesses, respectively.

In an embodiment of the lamp, the first heat sink is coupled in pivotable relationship to the second heat sink.

In an embodiment of the lamp, the first heat sink is pivotable within the lamp housing about at least one trunnion insertable into at least one trunnion receptacle.

In an embodiment of the lamp, the first heat sink comprises a first base having a front side and a rear side; the solid-state light source is disposed on the first base front side; and a plurality of first protrusions extend from the first base rear side.

In an embodiment of the lamp, the receiver section of the second heat sink comprises a receiver section base having a front side and a rear side; a plurality of receiver section heat transfer protrusions extend from the receiver section base front side; and the exterior section of the second heat sink is disposed on the receiver section base rear side.

In an embodiment of the lamp, the exterior section of the second heat sink comprises an exterior section base having a front side and rear side; the receiver section of the second heat sink is disposed on the exterior section base front side; and a plurality of exterior section heat transfer protrusions extend from the exterior section base rear side.

In an embodiment of the lamp, the housing comprises a wall and an aperture; and the second heat sink extends through the aperture and is disposed on the wall of the housing.

In an embodiment of the lamp, the lamp comprises at least one adjustment mechanism configured to displace the first heat sink relative to the second heat sink.

In an embodiment of the lamp, the sold-state light source comprises at least one light-emitting diode.

BRIEF DESCRIPTION OF FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION INCLUDING BEST MODE OF A PREFERRED EMBODIMENT

Figure 1:
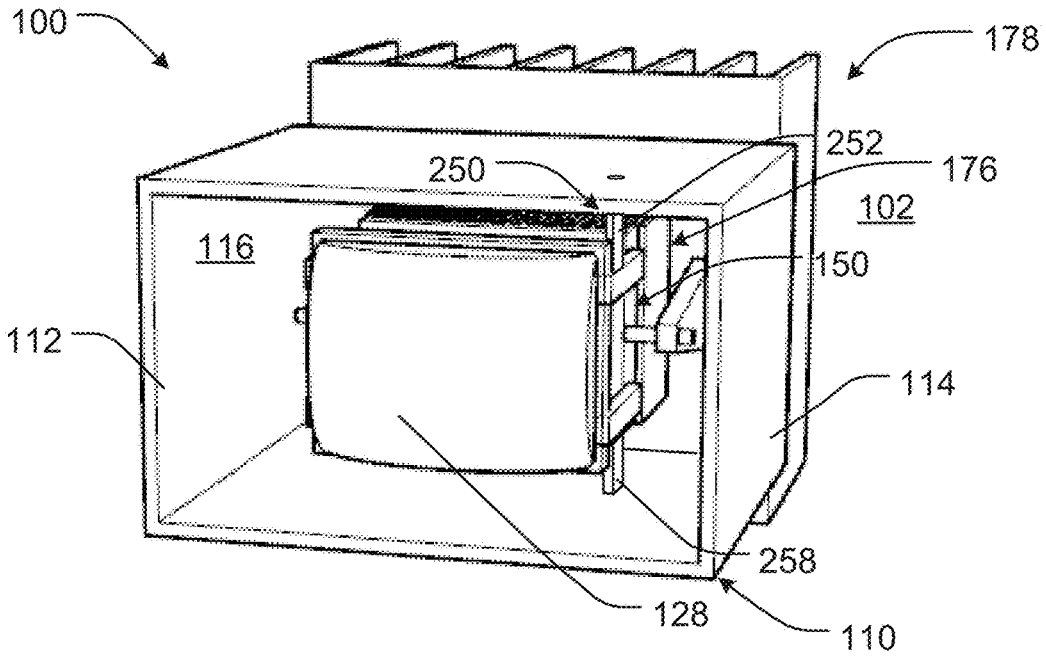
FIG. 1 is a front perspective view of a motor vehicle lamp 100, and more particularly a motor vehicle headlamp, according to the present disclosure.

One of skill in the art appreciates that the present disclosure is not limited in its application to the details of construction and the arrangement of components set forth in the following description or illustrated in the drawings. The embodiments herein may be capable of being practiced or being carried out in various ways. Also, the phraseology and terminology used herein are for purposes of description and should not be regarded as limiting. Further, such terms as "forward", "rearward", "left", "right", "upward", and "downward", etc., are words of convenience, not to be construed as limiting terms.

FIG. 1 shows motor vehicle lamp 100, and more particularly a headlamp. As shown, lamp 100 comprises a lamp housing 110, which has a front (light transmissive translucent or transparent) outer lens cover 112 and a rear support base 114, which mounts to a motor vehicle (not shown). As shown, lamp housing 110 defines an interior compartment 116, and an exterior region 102, particularly outside the lamp housing 110.

Figure 2:
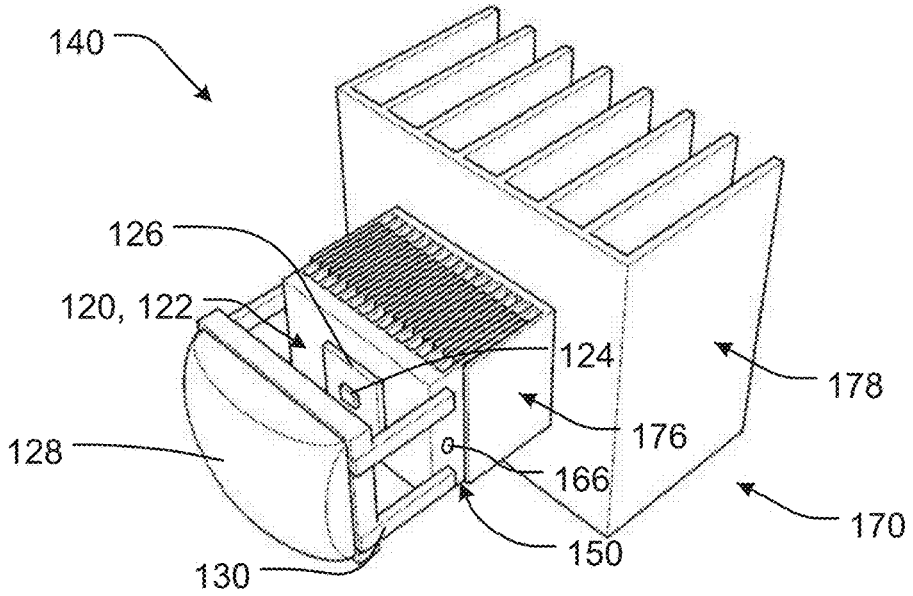
FIG. 2 is a top perspective view of a solid-state light source 120 and a multi-piece heat sink 140 of the lamp 100 of FIG. 1.

As best shown by FIGS. 1 and 2 taken in conjunction, within interior compartment 116 is disposed at least one solid-state light source 120, which may be a light-emitting diode (LED) module 122 comprising at least one light-emitting diode (LED) 124 joined to a substrate 126, such as a printed circuit board (PCB), in a known manner. The LED module 122 may operate in a power range of 5 watts to 25 watts, and more particularly in a power range of 10 watts to 25 watts. For a headlamp, the solid-state light source 120 is particularly configured to emit white light. However, for other applications, such as a taillamp, the solid-state light source 120 may be particularly configured to emit red light (e.g. brake-lamp) or yellow light (e.g. directional/turn-lamp).

Interior compartment 116 further includes at least one optic 128, particularly disposed between the solid-state light source 120 and the lens cover 112. Optic 128 is particularly configured to redirect and/or concentrate light from the solid-state light source 120 into a light beam, which may be particularly configured as a low beam or high beam of the motor vehicle. Optic 128 is spaced in front of the solid-state light source 120 by an air gap, particularly by being supported on support arms 130.

Figure 3:
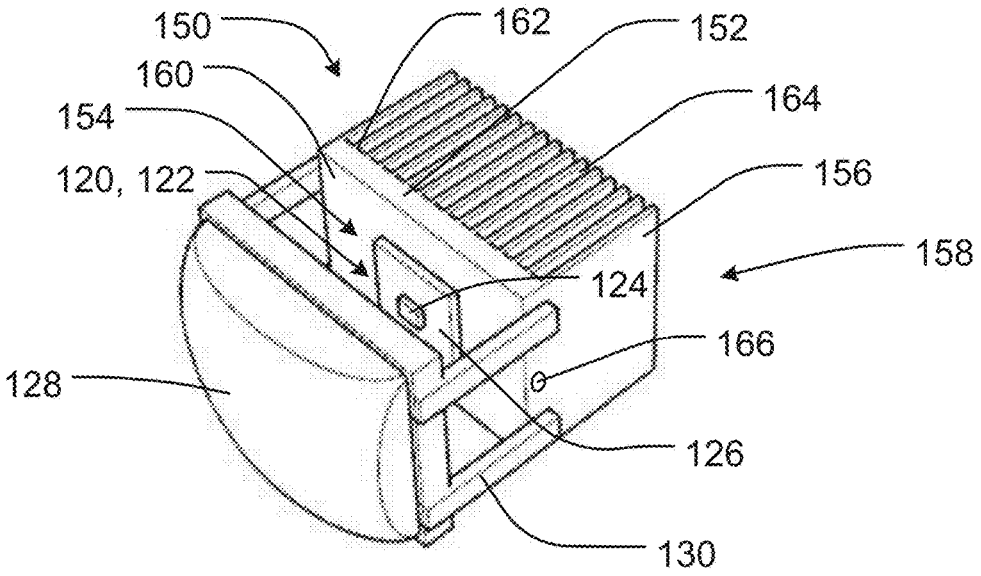
FIG. 3 is a close up perspective view of the solid-state light source 120 and a first heat sink 150 of the multi-piece heat sink 140 of the lamp 100 of FIG. 1.

As best shown by FIGS. 2 and 3, solid-state light source 120 is disposed on a first heat sink 150 in thermal communication therewith, which is also disposed within the interior compartment 116. First heat sink 150 is a component part of a multi-piece heat sink 140 configured to transfer heat generated within interior compartment 116, particularly by solid-state light source 120, to outside the lamp housing 110 such as to exterior region 102. Multi-piece heat sink 140 may be particularly configured to maintain the LED junction temperature below 150° C., and more particularly below 120° C., such as in a range of 90° C. to 110° C. during use of lamp 100.

As best shown by FIG. 3, first heat sink 150 comprises a first (heat sink) base 152, arranged at a front 154 of the first heat sink 150, and a plurality of cantilevered, heat transfer, first (heat sink) protrusions 156 arranged at a rear 158 of the first heat sink 150. As shown, the first (heat sink) protrusions 156 are elongated planar fins or ribs. As used herein with respect to the protrusions (e.g. fins or ribs), such as protrusion 156 or protrusion 182, etc., the term cantilevered is understood in that each protrusion (fin or rib) is connected at its proximal end to the base (e.g. first base 152 or receiver section base 180), but at its distal end is free.

As shown, the first (heat sink) base 152, which is shown to be rectangular, has a front side 160 and a rear side 162. The front side 160 of the first (heat sink) base 152 is shown to have a planar surface, on which the solid-state light source 120 is disposed, while the plurality of first (heat sink) protrusions 156 extend transverse from the rear side 162 of the first (heat sink) base 152. The first (heat sink) protrusions 156 extend parallel to one another away from the rear side 162 of the first (heat sink) base 152, with adjacent protrusions 156 being equally spaced from one another by a first (heat sink) recess 164 disposed between the first (heat sink) protrusions 156. As shown, the first (heat sink) base 152 and the plurality of first (heat sink) protrusions 156 may be formed as a single piece, unitary (monolithic) structure, such as by (aluminum) extrusion.

Figure 4:
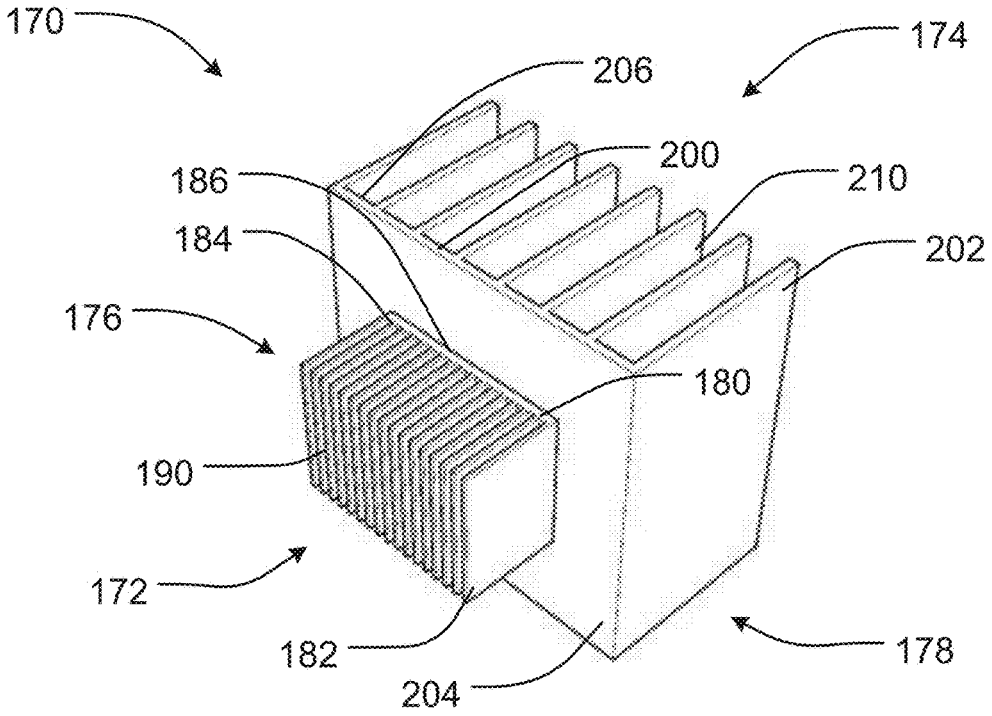
FIG. 4 is a close up perspective view of a second heat sink 170 of the multi-piece heat sink 140 of the lamp 100 of FIG. 1.

As best shown by FIGS. 2 and 4, lamp 100 further comprises a second heat sink 170, which provides a second component part of the multi-piece heat sink 140 in addition to the first heat sink 150. Second heat sink 170 comprises a heat-transferring receiver section 176 disposed at least partially within the interior compartment 116, and a heat-transferring exterior section 178 disposed in the exterior region 102 of the lamp housing 110. Thus, the solid-state light source 120, the first heat sink 150 and at least a portion of the receiver section 176 of the second heat sink 170 are disposed inside the lamp housing 110 (within interior compartment 116), while the exterior section 178 of the second heat sink 170 is disposed outside the lamp housing 110, particularly in exterior region 102.

The heat-transferring receiver section 176 of the second heat sink 170 has a receiver section base 180 and a plurality of cantilevered, heat transfer, receiver section protrusions 182 arranged at a front 172 of the second heat sink 170. As shown, the receiver section protrusions 182 are elongated planar fins or ribs.

As shown, the receiver section base 180, which is shown to be rectangular, has a front side 184 and a rear side 186. The front side 184 of the receiver section base 180 is shown to have the plurality of receiver section protrusions 182 extending transverse therefrom, while the rear side 186 of the receiver section base 180 is shown to have a planar surface, to which the external heat sink 178 of the second heat sink 170 is disposed.

As shown, the receiver section protrusions 182 extend parallel to one another away from the front side 184 of the receiver section base 180, with adjacent receiver section protrusions 182 being equally spaced from one another by a receiver section recess 190 disposed between the receiver section protrusions 182. As shown, the receiver section base 180 and the plurality of receiver section protrusions 182 of the second heat sink 170 may be formed as a single piece, unitary (monolithic) structure, such as by (aluminum) extrusion.

The heat-transferring exterior section 178 of the second heat sink 170 has an exterior section base 200 and a plurality of cantilevered, heat transfer, exterior section protrusions 202 arranged at a rear 174 of the second heat sink 170. As shown, the cantilevered exterior section protrusions 202 are elongated planar fins or ribs.

As shown, the exterior section base 200, which is shown to be rectangular, has a front side 204 and a rear side 206. The front side 204 of the exterior section base 200 is shown to have a planar surface, to which the receiver section 176 of the second heat sink 170 is disposed, while the plurality of exterior section protrusions 202 extend transverse from the rear side 206 of the exterior section base 200. As shown, the exterior section protrusions 202 extend parallel to one another away from the rear side 206 of the exterior section base 200, with the exterior section protrusions 202 being equally spaced from one another by an exterior section recess 210 disposed between the exterior section protrusions 202. As shown, the exterior section base 200 and the plurality of exterior section protrusions 202 of the second heat sink 170 may be formed as a single piece, unitary (monolithic) structure, such as by (aluminum) extrusion.

As shown, receiver section 176 and the exterior section 178 of the second heat sink 170 are disposed with the planar surface of the rear side 186 of the receiver section base 180 facing and joined with the planar surface of the front side 204 of the exterior section base 200. The receiver section 176 and exterior section 178 of the second heat sink 170 may be joined by any suitable means, including (thermal) adhesive disposed between the two planar surfaces, welding, mechanical fastening (e.g. threaded fastener).

In other embodiments, the receiver section 176 and the exterior section 178 of the second heat sink 170 may be formed as a single piece unitary (monolithic structure), such as by (aluminum) extrusion, in which case the receiver section base 180 may be eliminated. As a result, the receiver section protrusions 182 may extend parallel to one another away from the front side 204 of the exterior section base 200.

Figure 5:
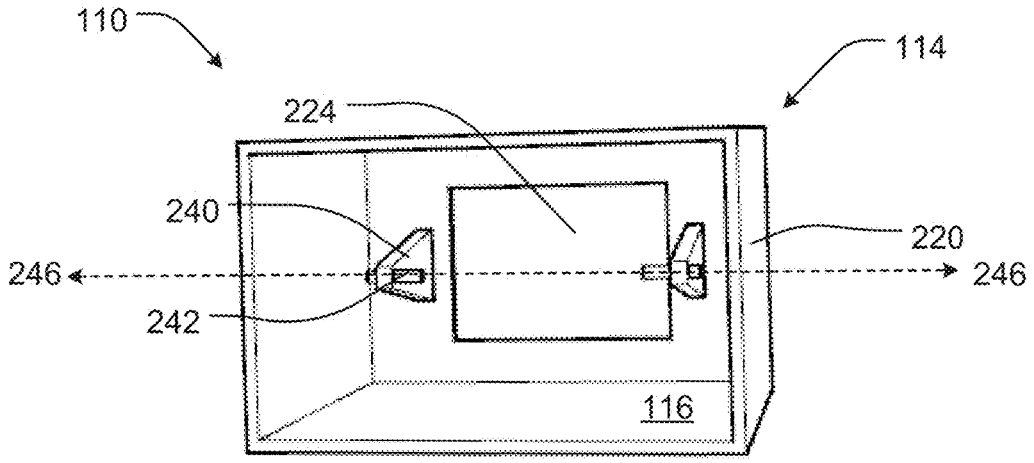
FIG. 5 is a front perspective view of the base 114 of the lamp housing 110 of the lamp 100 of FIG. 1.
Figure 6:
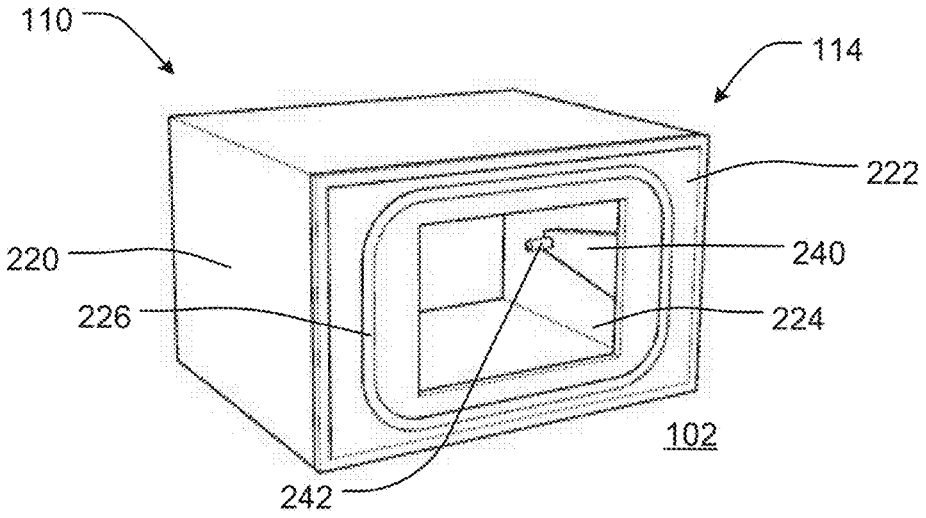
FIG. 6 is a rear perspective view of the base 114 of the lamp housing 110 of the lamp 100 of FIG. 1.

Referring now to FIGS. 5 and 6, rear support base 114 of lamp housing 110 comprises a surrounding side wall 220 and a rear wall 222. Rear wall 222 includes a rear aperture 224 through which the second heat sink 170 is inserted (from the rear) into the interior compartment 116 during assembly of lamp 100.

More particularly, the receiver section 176 of second heat sink 170 is inserted into the interior compartment 116 of rear support base 114/lamp 100 through aperture 224. The second heat sink 170 is then joined to the rear support base 114 when the front side 204 of the exterior section base 200 of the second heat sink 170 makes contact with the rear wall 222 of rear support base 114. In particular, a water-tight and air-tight bonding/sealing composition 226, which may be a gasket, shaped in the form of a closed annular ring, is first disposed on the rear wall 222 of the rear support base 114 which surrounds aperture 224. The second heat sink 170 is then be joined to the rear support base 114 of the lamp housing 110 when the front side 204 of the exterior section base 200 of the second heat sink 170 makes contact with the bonding/sealing composition 226 disposed on the rear wall 222 of rear support base 114. The bonding/sealing composition 226 is provided as a bead of moisture cure urethane adhesive, which forms a water-tight and air-tight bond between the second heat sink 170 and the housing to inhibit water, road debris and other undesirable fluids and particulate from entering lamp housing 110.

With regards to the assembly of the first heat sink 150 within the compartment 116 of housing 110, as shown, within compartment 116 of the housing 110 are two spaced apart stanchions 240, which each include trunnion 242, shown in the form of a cylindrical pin. When assembled, each of the trunnions 242 respectively occupy a trunnion receptacle 166, see FIGS. 2 and 3 (shown in the form of a cylindrical recess), formed in the lateral sides of the first (heat sink) base 152.

Figure 7A:
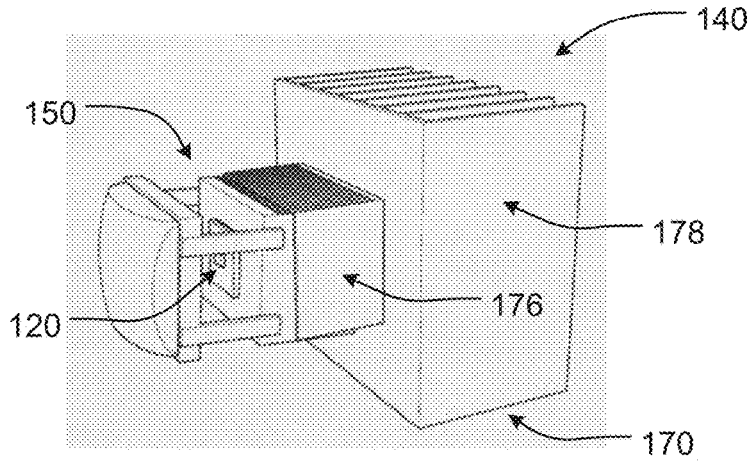
FIG. 7A is a perspective view of the solid-state light source 120 and the multi-piece heat sink 140 of the lamp 100 of FIG. 1 with the solid-state light source 120 having a vertical aim tilted upward at approximately 4 degrees.
Figure 7B:
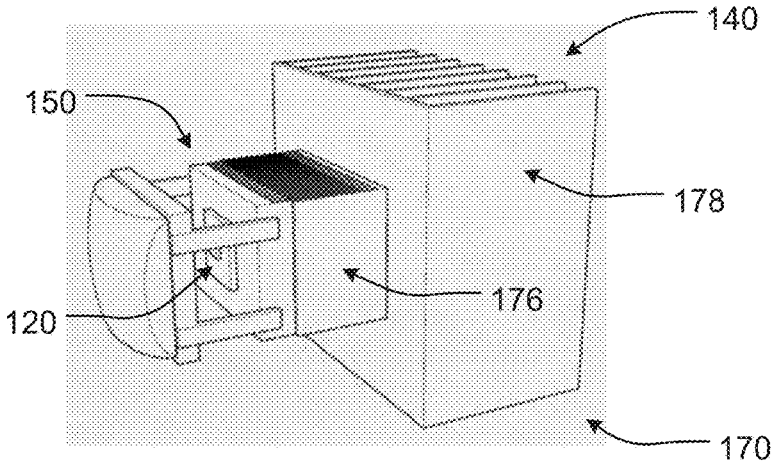
FIG. 7B is a perspective view of the solid-state light source 120 and the multi-piece heat sink 140 of the lamp 100 of FIG. 1 with the solid-state light source 120 having a vertical aim neutral (i.e. not tilted upwards or downwards)
Figure 7C:
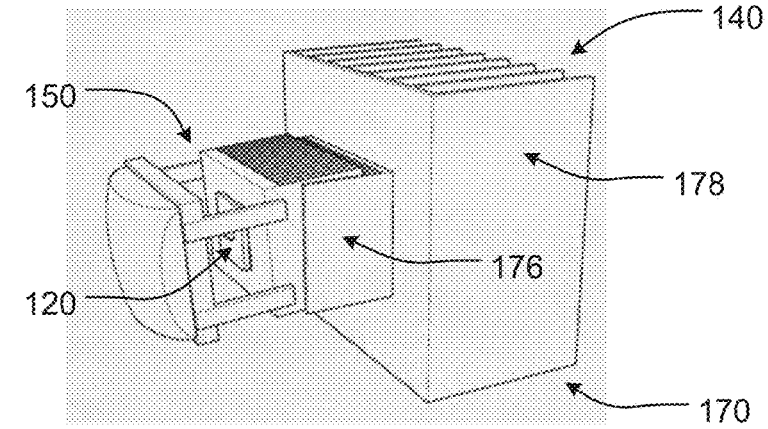
FIG. 7C is a perspective view of the solid-state light source 120 and the multi-piece heat sink 140 of the lamp 100 of FIG. 1 with the solid-state light source 120 having a vertical aim tilted downward at approximately 4 degrees.

Referring to FIGS. 7A-7C (housing 110 not shown, for clarity), with the use of the stanchions 240 and trunnions 242, the solid-state light source 120 and the first heat sink 150 are adjustable (pivotable) within the lamp housing 110. FIG. 7A is a perspective view of the solid-state light source 120 and the multi-piece heat sink 140 of the lamp 100 of FIG. 1 with the solid-state light source 120 having a vertical aim tilted upward at approximately 4 degrees, while FIG. 7B is a perspective view of the solid-state light source 120 and the multi-piece heat sink 140 of the lamp 100 of FIG. 1 with the solid-state light source 120 having a vertical aim neutral (i.e. not tilted upwards or downwards), and FIG. 7C is a perspective view of the solid-state light source 120 and the multi-piece heat sink 140 of the lamp 100 of FIG. 1 with the solid-state light source 120 having a vertical aim tilted downward at approximately 4 degrees;

Such adjustment of the lamp 100 is desirable in order to aim the lamp 100. As required of motor vehicle head-lamps, the lamp 100 includes at least one aiming adjustment mechanism 250 (see FIG. 1) arranged to pivot the solid-state light source 120 and the first heat sink 150. More particularly, the solid-state light source 120 and the first heat sink 150 are adjustable (pivotable) within the lamp housing 110 about the trunnions 242 inserted into the trunnion receptacles 166 formed in the first heat sink 150 (particularly about a pivot axis 246 (see FIG. 5) which extends horizontally) to provide aiming adjustment. Other adjustment linkages could be provided to make lighting source 120 and first heat sink 150 displaceable, e.g. through linear translation, pivoting, or a combination thereof, relative to second heat sink 170 in order to aim lamp 100.

Referring briefly to FIG. 1, the aiming adjustment mechanism 250 may comprise an adjustment member 252, which may be a screw which threadably engaged with lamp housing 110 and a biasing member 258, which may be a compression spring. As the adjustment member/screw 252 is rotated (threaded) clockwise, the adjustment member/screw 252 may pivot the solid-state light source 120 downward against the bias compression of biasing member/spring 258. As the adjustment member/screw 252 is rotated (threaded) counter-clockwise, the biasing member/spring 258 may pivot the solid-state light source 120 upward via decompression thereof.

It should also be understood that, with the foregoing arrangement of the lamp 100, the first heat sink 150 is coupled in displaceable relationship to the second heat sink 170, whereby a position of the solid-state light source 120 is adjustable relative the lamp housing 110, particularly via the foregoing adjustment (pivot) mechanism 250. More particularly, the first (heat sink) protrusions 156 and first (heat sink) recesses 164 of the first heat sink 150 are displaceable relative to the receiver section protrusions 182 and receiver section recesses 190 of the receiver section 176 of the second heat sink 170.

Figure 8:
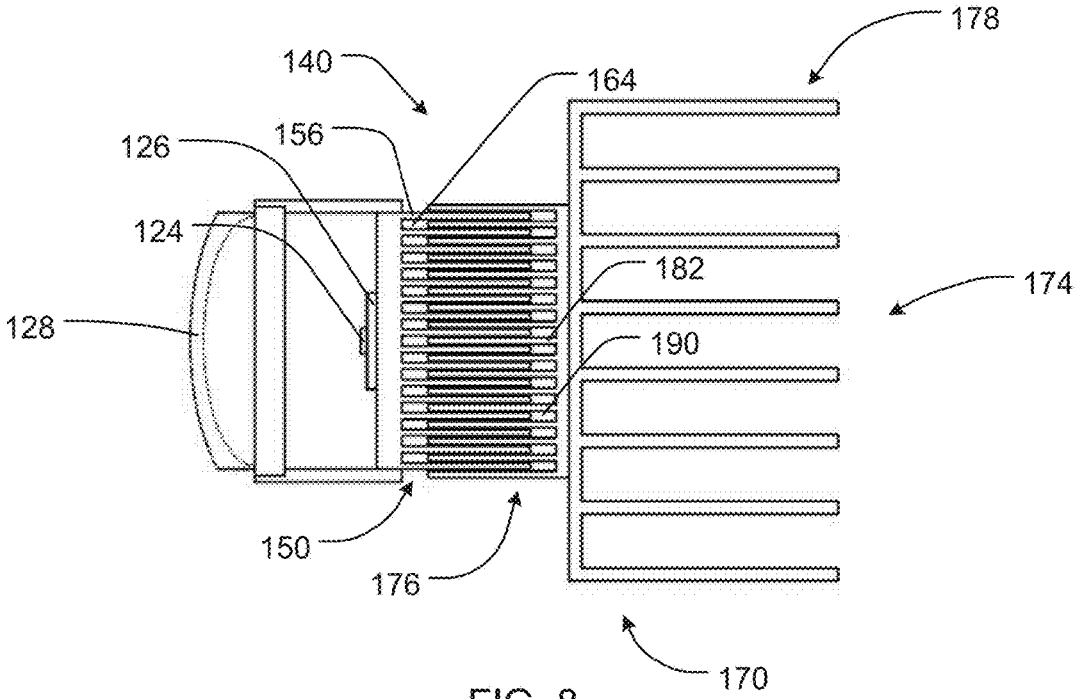
FIG. 8 is a top view of the solid-state light source 120 and the multi-piece heat sink 140 of the lamp 100 of FIG. 1.
Figure 9:
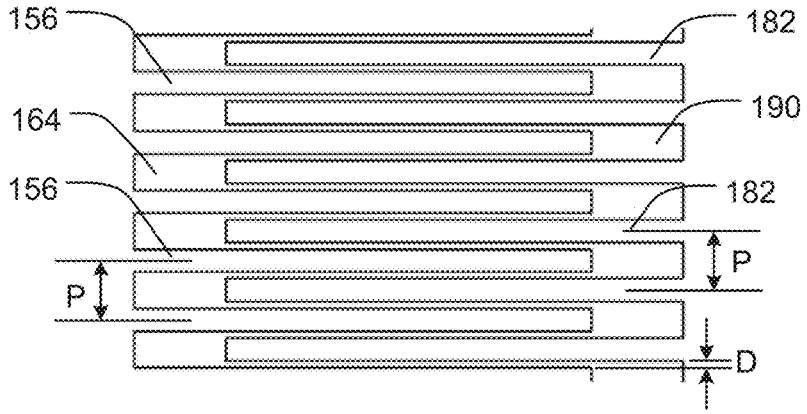
FIG. 9 is a close up top view of the heat transfer protrusions 156 of the first heat sink 150 disposed within the heat transfer recesses 190 of the second heat sink 170, and the heat transfer protrusions 182 of the second heat sink 170 disposed within the heat transfer recesses 164 of the first heat sink 150.

Referring now to FIGS. 8 and 9, the first heat sink 150 and the receiver section 176 of the second heat sink 170 are arranged such that each one of the first (heat sink) protrusions 156 is disposed within a corresponding one of the receiver section recesses 190 of the second heat sink 170 in a one-to-one relationship, and each one of the receiver section protrusions 182 is disposed within a corresponding one of the first (heat sink) recesses 164 in a one-to-one relationship. The width of the protrusions 156 and the recesses 164 of the first heat sink 150 match those of the protrusions 182 and the recesses 190 of receiver section 176 of the second heat sink 170, such that the protrusions 156 of the first heat sink 150 are centered in the receiver section recesses 190 of the second heat sink 170 and the receiver section protrusions 182 of the second heat sink 170 are centered in the recesses 164 of the first heat sink 150. In this condition first protrusions (or fins) 156 and receiver section protrusions (or fins) 182 can be described as interleaved.

Also as shown, the plurality of first (heat sink) protrusions 156 are preferably not in contact (contactless) with the plurality of receiver section protrusions 182. Heat transfer can then occur via radiation or convection. However, the present disclosure contemplates that the plurality of first (heat sink) protrusions 156 may also be in contact with the plurality of receiver section protrusions 182, which is expected to enhance heat transfer and subsequent cooling, such as through heat transfer via conduction. The plurality of first (heat sink) protrusions 156 are preferably not in contact with the plurality of receiver section protrusions 182 due to vibration of the vehicle, which may cause the protrusions 156, 182 to chafe on each other (which may shave material from the protrusions 156, 182) or cause vibration noise.

With the foregoing arrangement, heat generated by the solid-state light source 120 within the lamp housing 110 is transferred outside the lamp housing 110 via the first heat sink 150 and the second heat sink 170. More particularly, heat generated by solid-state light source 120 is first transferred, in order, to the first heat sink 150, then to the receiver section 176 of the second heat sink 170, then to the exterior section 178 of the second heat sink 170. Thus, the first heat sink 150 and the second heat sink 170 are in thermal communication with one another.

In particular, when the foregoing lamp 100 is assembled, the solid-state light source 102 and the first heat sink 150 are arranged such that, when heat is generated by the solid-state light source 120, at least a portion of the heat is transferred from the solid-state light source 120 to the first heat sink 150 by thermal conduction. Thereafter, at least a portion of the heat is transferred from the first heat sink 150 to the receiver section 176 of the second heat sink 170 by thermal radiation or convection (or thermal conduction if the first heat sink 150 and second heat sink 170 are in physical contact (e.g. protrusions touching one another). Thereafter, at least a portion of the heat transferred to the receiver section 176 of the second heat sink 170 is transferred to the exterior section 178 of the second heat sink 170 by thermal conduction. Thereafter, at least a portion of the heat transferred to the exterior section 178 of the second heat sink 170 is transferred to the surrounding air by thermal radiation or convection. In the foregoing manner, the lamp 100 exhibits reduced internal temperatures.

Figure 10:
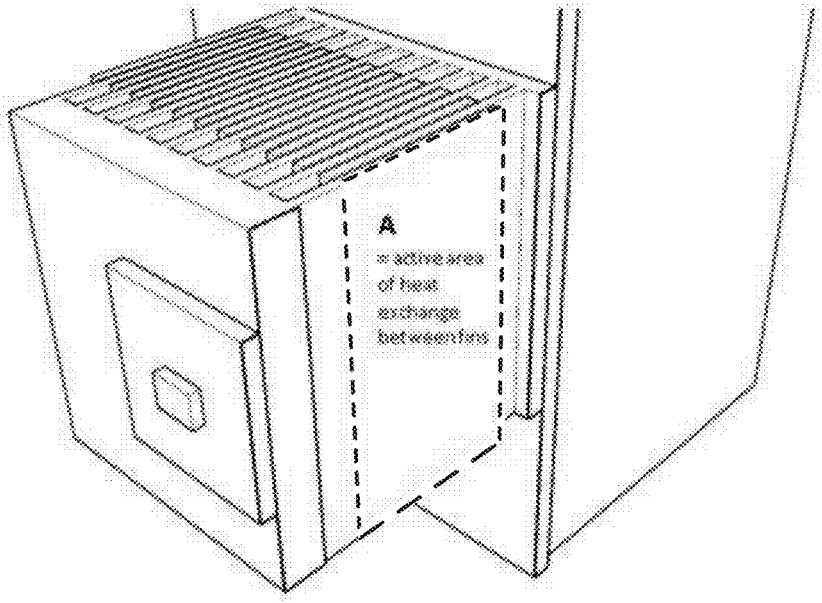
FIG. 10 is cross-sectional perspective view of the first heat sink 150 showing the active protrusion area A of the heat transfer protrusions 156.

Referring now to FIGS. 9-10, in FIG. 9 there is shown a measure of the gap distance D between the first (heat sink) protrusions 156 and the receiver section protrusions 182 of the second heat sink 170, while in FIG. 10 there is shown a measure of the active (protrusion) area A of heat exchange between the first (heat sink) protrusions 156 and the receiver section protrusions 182 of the second heat sink 170.

The efficiency of heat transfer increases and the temperature drop across the gap distance D decreases with a smaller gap distance D and a larger active protrusion area A. Such can be combined in the ratio D/A, which preferably is as small as possible.

Figure 11:
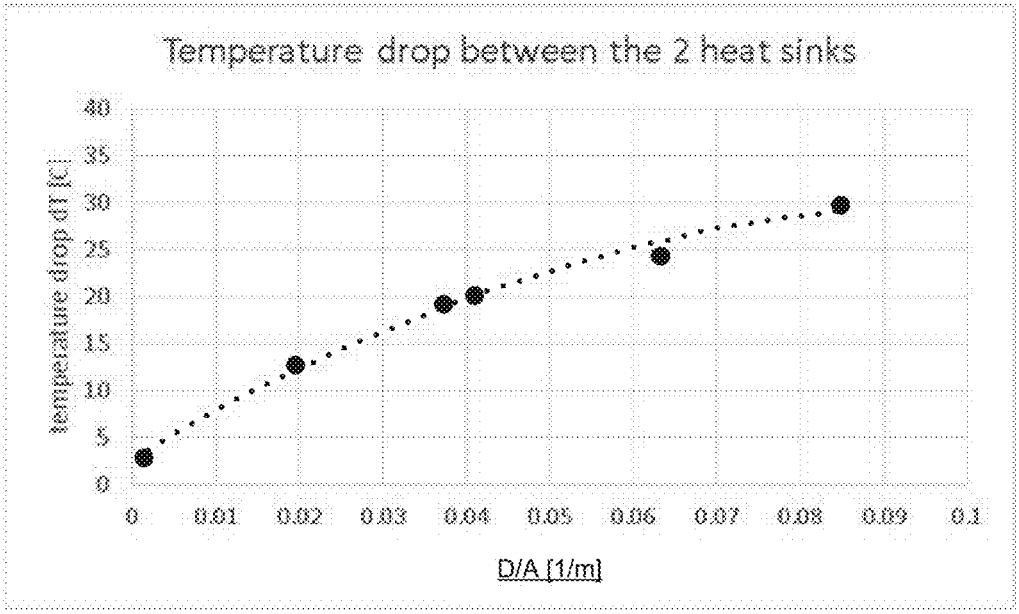
FIG. 11 is graph of temperature drop between the first heat sink 150 and the second heat 170.

Referring to FIG. 11, there is shown data of a series of simulations for different gap distances D and active protrusion areas A. The simulations were performed for an LED with a thermal power of 14 watts (1×4 Oslon Black Flat at 1.2A). While the values may change for an LED of different power, the values will scale up or down accordingly. The ambient air outside of the housing was 25° C. The graph in FIG. 11 shows the temperature drop between the first heat sink 150 and the second heat sink 170 as a function of the ratio d/A in 1/m.

While the present system may be able to provide a greater temperature drop, a 10° C.-15° C. temperature drop for application is generally adequate. This may be understood as the same approximate temperature difference between the air inside a large housing, such as a pick-up truck lamp housing, and the outside air. In the foregoing manner, the performance of the system of the present disclosure may be expected to be similar to that of a system with an internal heat sink wholly in a large housing, albeit with the present disclosure providing a much smaller packaging size, particularly due to the portion of the second heat sink 170 outside the lamp housing 110.

By way of example, starting with a target temperature drop of 10° C.-15° C., FIG. 11 shows that the corresponding ratio D/A is approximately 0.02/m. While there are many combinations of gap distance D and active protrusion area A which will produce the same result, in the present case, heat sink 150 was dimensioned at 40 mm wide and 30 mm tall, with protrusions 156 at 20 mm deep. The receiver section protrusions 182 of the second heat sink 170 have corresponding dimensions, albeit with an additional receiver section protrusion 182.

Using an overlapping depth for the first (heat sink) protrusions 156 and the receiver section protrusions 182 of the second heat sink 170 of 16 mm, when such is multiplied by the height of the protrusions 156, 182, such results in an active protrusion area A at one side of each protrusion 156 or 182 of 480 $mm^2$ (i.e. 16 mm×30 mm). When such is multiplied by the area of 16 protrusions, each having two sides, the total active protrusion area A is 15,360 $mm^2$ (i.e. 480 mm×16×2).

With 16 first (heat sink) protrusions 156 occupying a cumulative 40 mm width, this results in about a 2.5-2.6 mm protrusion pitch P. With the first (heat sink) protrusions 156 and receiver section protrusions 182 of the second heat sink 170 each having a thickness of 1 mm, such leaves a 0.3 mm air space on each side of the first (heat sink) protrusions 156 and receiver section protrusions 182 of the second heat sink 170. As such, D/A=0.3 mm/15,360 $mm^2$=0.02/1,000 mm=0.02/m.

The first heat sink 150 and the second heat sink 170 are preferably each formed of extruded aluminum pieces, which are low cost and provide higher (209 W/mK) material thermal conductivity than cast aluminum parts (80-120 W/mK). The post processing for the extrusion is minimal and consists of forming mounting holes.

Due to the adjustability of the first heat sink 150 for vertical aiming of the solid-state light source 120, the first (heat sink) protrusions 156 may be slightly taller than the receiver section protrusions 182 of the second heat sink 170, particularly to ensure active protrusion areas A do not decrease over the pivot angle of the the first heat sink 150.

The size of the external heat sink 178 of the second heat sink 170 is determined by the LED power and the environmental temperatures. If smaller heat sinks are needed for the first heat sink 150 and the receiver section 176 of the second heat sink 170, the resulting higher temperature drop can be compensated for with a larger external heat sink 178 of the second heat sink 170.

Figure 12:
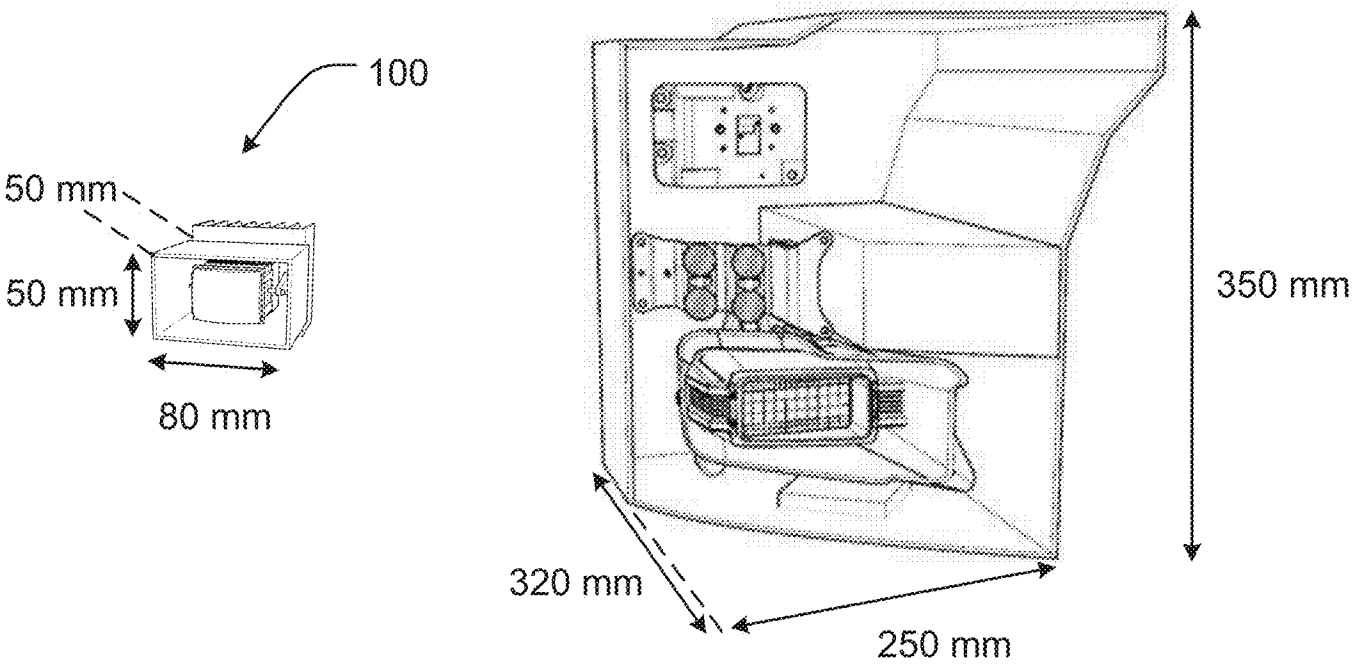
FIG. 12 is an approximate scale comparison of a vehicle lamp 100 of the present disclosure to a conventional commercial pick-up truck lamp housing having a wholly internal heat sink.

The motor vehicle lamp 100 disclosed is expected to provide heat dissipation performance which is similar to the heat dissipation performance of a large headlamp housing (e.g. pick-up truck headlamp) that uses a wholly internal heat sink. As shown in FIG. 12, the lamp housing 110 can be reduced to a fraction of the volume previously required by using the multi-piece heat sink 140 of the present disclosure.

While an air gap has been described as being located on each side of the first (heat sink) protrusions 156 and receiver section protrusions 182 of the second heat sink 170, to inhibit potential chafing and noise, such is not thermally optimal. The gaps between the protrusions 156, 182 can be filled with a material or fluid as long as it does not create problems under vibration and shock tests and the parts remain movable. Possible materials may be soft flexible sponges (e.g. foam), which are attached to one of the interacting protrusions 156, 182. Viscous fluids or thermal paste could be employed if their characteristics are suitably chosen, using conventional skill in the art, to resist flowing out of the gap given higher temperatures and vibrations that may be encountered.

While a preferred embodiment of the present disclosure has been described, it should be understood that various changes, adaptations and modifications can be made therein without departing from the spirit of the disclosure and the scope of the appended claims. The scope of the disclosure should, therefore, be determined not with reference to the above description, but instead should be determined with reference to the appended claims along with their full scope of equivalents. Furthermore, it should be understood that the appended claims do not necessarily comprise the broadest scope of the disclosure which the applicant is entitled to claim, or the only manner in which the disclosure may be claimed, or that all recited features are necessary.

Non-limiting list of reference characters used herein:

100 lamp/headlamp
102 exterior region
110 lamp housing
112 lens cover
114 rear support base
116 interior compartment
120 solid-state light source
122 light-emitting diode (LED) module
124 light-emitting diode (LED)
126 light-emitting diode (LED) substrate
128 optic
130 support arm
140 multi-piece heat sink
150 first heat sink
152 first (heat sink) base
154 first (heat sink) front
156 heat transfer first (heat sink) protrusion
158 first (heat sink) rear
160 first (heat sink) base front side
162 first (heat sink) base rear side
164 first (heat sink) recess
166 trunnion receptacle
170 second heat sink
172 second (heat sink) front
174 second (heat sink) rear
176 second (heat sink) heat-transferring receiver section

178 second (heat sink) heat-transferring exterior section
180 second (heat sink) receiver section base
182 heat transfer second (heat sink) receiver section protrusion
184 second (heat sink) receiver section base front side
186 second (heat sink) receiver section base rear side
190 second (heat sink) receiver section recess
200 second (heat sink) exterior section base
202 heat transfer second (heat sink) exterior section protrusion
204 second (heat sink) exterior section base front side
206 second (heat sink) exterior section base rear side
210 second (heat sink) exterior section recess
220 base side wall
222 base rear wall
224 rear wall aperture
226 real wall bonding/sealing composition
240 stanchion
242 trunnion
246 pivot axis
250 aiming adjustment mechanism
252 adjustment member
258 biasing member
A active protrusion area
D gap distance
P protrusion pitch

We claim:

1. A motor vehicle lamp (100), comprising:

a lamp housing (110) defining an interior compartment (116) and an exterior region (102);

a solid-state light source (120) disposed on a first heat sink (150) in thermal communication therewith, the first heat sink (150) being disposed within the interior compartment (116);

a second heat sink (170) having an heat-transferring exterior section (178) disposed in the exterior region (102) of the lamp housing (110) and further having a heat-transferring receiver section (176) disposed at least partially within the interior compartment (116); and the first heat sink (150) being in thermal communication with the second heat sink (170) and coupled in displaceable relationship to the second heat sink (170), whereby a position of said solid-state light source (120) is adjustable relative the lamp housing (110); wherein the first heat sink (150) is coupled in pivotable relationship to the second heat sink (170).

2. The motor vehicle lamp (100) of claim 1 wherein:

at least one of the first heat sink (150) and the receiver section (176) of the second heat sink (170) has at least one heat transfer protrusion (156, 182);

at least one of the first heat sink (150) and the receiver section (176) of the second heat sink (170) has at least one recess (164, 190); and at least one of the at least one heat transfer protrusion (156, 182) and the at least one recess (164, 190) is displaceable relative to one another when the first heat sink (150) and the second heat sink (170) are coupled in displaceable relationship.

3. The motor vehicle lamp (100) of claim 2 wherein:

the at least one heat transfer protrusion (156, 182) is disposed within the at least one recess (164, 190).

4. The motor vehicle lamp (100) of claim 1 wherein:

at least one of the first heat sink (150) and the receiver section (176) of the second heat sink (170) has a plurality of heat transfer protrusions (156, 182);

at least one of the first heat sink (150) and the receiver section (176) of the second heat sink (170) has a plurality of recesses (164, 190); and at least one of the plurality of heat transfer protrusions (156, 182) and the plurality of recesses (164, 190) is displaceable relative to one another when the first heat sink (150) and the second heat sink (170) are coupled in displaceable relationship.

5. The motor vehicle lamp (100) of claim 4 wherein:

each heat transfer protrusion (156, 182) of the plurality of heat transfer protrusions (156, 182) is disposed within a recess (164, 190) of the plurality of recesses (164, 190).

6. The motor vehicle lamp (100) of claim 1 wherein:

at least one of the first heat sink (150) and the receiver section (176) of the second heat sink (170) has a plurality of heat transfer protrusions (156, 182) and at least one recess (164, 190); and the at least one recess (164, 190) is disposed between adjacent heat transfer protrusions (156, 182) of the plurality of heat transfer protrusions (156, 182).

7. The motor vehicle lamp (100) of claim 6 wherein:

at least one of the first heat sink (150) and the receiver section (176) of the second heat sink (170) has a plurality of recesses (164, 190); and each recess (164, 190) of the plurality of recesses (164, 190) is disposed between adjacent heat transfer protrusions (156, 182) of the plurality of heat transfer protrusions (156, 182).

8. The motor vehicle lamp (100) of claim 1 wherein:

the first heat sink (150) has a plurality of heat transfer first protrusions (156) and a plurality of first recesses (164);

the receiver section (176) of the second heat sink (170) has a plurality of heat transfer receiver section protrusions (182) and a plurality of receiver section recesses (190);

each first protrusion (156) of the plurality of first protrusions (156) is disposed within a receiver section recess (190) of the plurality of receiver section recesses (190), respectively; and each receiver section protrusion (182) of the plurality of receiver section protrusions (182) is disposed within a first recess (164) of the plurality of first recesses (164), respectively.

9. The motor vehicle lamp (100) of claim 1 wherein:

the first heat sink (150) is pivotable within the lamp housing (110) about at least one trunnion (242) insertable into at least one trunnion receptacle (166).

10. The motor vehicle lamp (100) of claim 1 wherein:

the housing (110) comprises a wall (222) and an aperture (224); and the second heat sink (170) extends through the aperture (224) and is disposed on the wall (222) of the housing (110).

11. The motor vehicle lamp (100) of claim 1 further comprising:

at least one adjustment mechanism (250) configured to displace the first heat sink (150) relative to the second heat sink (170).

12. The motor vehicle lamp (100) of claim 1 wherein:

the sold-state light source (120) comprises at least one light-emitting diode (124).

13. A motor vehicle lamp (100), comprising:

a lamp housing (110) defining an interior compartment (116) and an exterior region (102);

a solid-state light source (120) disposed on a first heat sink (150) in thermal communication therewith, the first heat sink (150) being disposed within the interior compartment (116);

a second heat sink (170) having an heat-transferring exterior section (178) disposed in the exterior region (102) of the lamp housing (110) and further having a heat-transferring receiver section (176) disposed at least partially within the interior compartment (116); and the first heat sink (150) being in thermal communication with the second heat sink (170) and coupled in displaceable relationship to the second heat sink (170), whereby a position of said solid-state light source (120) is adjustable relative the lamp housing (110); wherein the first heat sink (150) comprises a first base (152) having a front side (160) and a rear side (162);

the solid-state light source (120) is disposed on the first base front side (160); and a plurality of first protrusions (156) extend from the first base rear side (162).

14. The motor vehicle lamp (100) of claim 13 wherein:

the receiver section (176) of the second heat sink (170) comprises a receiver section base (180) having a front side (184) and a rear side (186);

a plurality of receiver section heat transfer protrusions (182) extend from the receiver section base front side (184); and the exterior section (178) of the second heat sink (170) is disposed on the receiver section base rear side (186).

15. The motor vehicle lamp (100) of claim 14 wherein:

the exterior section (178) of the second heat sink (170) comprises an exterior section base (200) having a front side (204) and rear side (206);

the receiver section (176) of the second heat sink (170) is disposed on the exterior section base front side (204); and a plurality of exterior section heat transfer protrusions (202) extend from the exterior section base rear side (206).

* * * * *